US006471788B1

(12) United States Patent
Minevski et al.

(10) Patent No.: US 6,471,788 B1
(45) Date of Patent: Oct. 29, 2002

(54) FERRATE CONVERSION COATINGS FOR METAL SUBSTRATES

(75) Inventors: Zoran Minevski, The Woodlands, TX (US); Jason Maxey, College Station, TX (US); Carl Nelson, College Station, TX (US); Cahit Eylem, College Station, TX (US)

(73) Assignee: Lynntech Coatings, Ltd., College Station, TX (US)

( * ) Notice: Subject to any disclaimer, the term of this patent is extended or adjusted under 35 U.S.C. 154(b) by 0 days.

(21) Appl. No.: 09/461,944

(22) Filed: Dec. 15, 1999

(51) Int. Cl.[7] ..... C23C 22/48

(52) U.S. Cl. ..... 148/273; 148/284; 148/287; 106/14.21; 252/186.21; 252/186.33

(58) Field of Search ..... 148/273, 284, 148/287; 106/14.21; 252/186.21, 186.33

(56) References Cited

U.S. PATENT DOCUMENTS

| | | | | |
|---|---|---|---|---|
| 2,758,090 A | | 8/1956 | Mills et al. | |
| 2,850,416 A | | 9/1958 | Castle et al. | |
| 3,365,313 A | | 1/1968 | Roberts, Jr. | |
| 3,960,676 A | | 6/1976 | Miyosawa | |
| 4,435,256 A | | 3/1984 | Deininger | |
| 4,435,257 A | | 3/1984 | Deininger | |
| 4,451,338 A | | 5/1984 | Deininger | |
| 4,551,326 A | | 11/1985 | Thompson | |
| 4,606,843 A | | 8/1986 | Kaezur | |
| 4,755,224 A | | 7/1988 | Bibber | |
| 4,828,615 A | | 5/1989 | Cape | |
| 4,878,963 A | | 11/1989 | Bibber | |
| 5,217,584 A | | 6/1993 | Deininger | |
| 5,370,857 A | * | 12/1994 | Deininger | 423/633 |
| 5,380,443 A | * | 1/1995 | Deininger et al. | 210/724 |
| 5,637,143 A | | 6/1997 | Jenkins | |
| 5,746,994 A | | 5/1998 | Johnson | |

FOREIGN PATENT DOCUMENTS

| | | |
|---|---|---|
| CA | 1 217 412 | 2/1987 |
| DK | 0 724 653 B1 | 10/1992 |
| EP | 0 090 512 A | 10/1983 |
| EP | 0 523 288 A1 | 1/1993 |
| FR | 616 849 A | 2/1927 |
| FR | 2 148 423 A | 3/1974 |
| JP | 49 037895 A | 4/1974 |
| WO | 99/29831 | 12/1999 |

OTHER PUBLICATIONS

K. Bouzek, I. Rousar, Influence of anode material on current yields during ferrate (vi) production by anodic iron dissolution Part I: Current efficiency during anodic dissolution of grey cast iron to ferrate (vi) in concentrated alkali hydroxide solutions, revised Nov. 28, 1995 pp. 919 to 923.

(List continued on next page.)

*Primary Examiner*—John Sheehan
*Assistant Examiner*—Andrew L. Oltmans
(74) *Attorney, Agent, or Firm*—Streets & Steele; Jeffrey L. Streets

(57) ABSTRACT

A method employing oxide film conversion coatings prepared using ferrate (VI) as the oxidizing agent is disclosed. Metal substrates or surfaces, such as aluminum, aluminum alloys or other metals, are contacted with an aqueous solution comprising ferrate (VI) anions to form a corrosion resistant conversion coating on the surface thereof. The ferrate anion concentration is preferably between about 0.0166% and about 1.66% by weight. The coating process is carried out by dipping, spraying, or painting at temperatures ranging from 25° C. to 100° C. for a period of time ranging from about 1 second to about 5 minutes.

18 Claims, 5 Drawing Sheets

OTHER PUBLICATIONS

K. Bouzek, I Rousar, M.A. Taylor, Influence of anode material on current yields during ferrate (vi) production by anodic iron dissolution Part II, Current effiency during anodic dissolution white cast iron to ferrate (iv) in concentrated alkali hydroxide solutions, revised Jan. 11, 1996, pp. 925–931.

K. Bouzek, I Rousar, Current efficiency during anodic dissolution of iron to ferrate (vi) in concentrated alkali hydroxide solutions revised Apr. 23, 1993 pp. 1317–1322.

A. Denvir, D. Pletcher, Electrochemical generation of ferrate Part I: Dissolution of an iron wool bed anode, revised Oct. 31, 1995 pp. 815–821.

A. Denvir, D. Pletcher, Electrochemical generation of ferrate Part 2: Influence of anode composition revised Oct. 31, 1995 pp. 823–827.

Lionel Delaude and Pierre Laszlo, A Novel Oxidizing Reagent Based on Potassium Ferrate (VI) Apr. 5, 1996 pp. 6360–6370.

Henry J. Hrostowski and Allen B. Scott, The Magnetic Susceptibility of Potassium Ferrate, Jun. 10, 1949. pp. 105–107.

G.W. Thompson, L.T. Ockerman and J.M. Schreyer, Preparation and Purification of Potassium Ferrate VI, Aug. 9, 1950, pp. 1379–1381.

Database WPI Section Ch, Week 197450 Derwent Publications Ltd., London, GB; Class E36, AN 1974–86123V XP002135871 (English abstract of JP 49 037895).

* cited by examiner

FIG. 4A

| Corresponding Example | Boehmite | Conversion Solution Conditions | | | | | Post-Sealants | | Corrosion Performance |
|---|---|---|---|---|---|---|---|---|---|
| | | Ferrate (mM) | pH | Additives | Temp (° C) | Time | $Ca(OH)_2$ | Silicate | Salt Fog Results (days) |
| 1 | Yes | No Conversion step | | | | | No | No | 1 |
| 2, 3, 4, 5 | Yes | Same as examples 7, 8, 9 and 10 | | | | | No | No | 3 |
| 7 | No | 50 | 14 | No | 25 | 10 sec | Yes | Yes | 12 |
| 7 | Yes | 3 | 14 | No | 25 | 1 sec | Yes | Yes | 8 |
| 7 | Yes | 10 | 14 | No | 25 | 1 sec | Yes | Yes | 16 |
| 7 | Yes | 25 | 14 | No | 25 | 5 sec | Yes | Yes | 34 |
| 7 | Yes | 50 | 14 | No | 25 | 1 sec | Yes | Yes | 14 |
| 7 | Yes | 80 | 14 | No | 25 | any | Yes | Yes | 1 |
| 7 | Yes | 3 | 14 | No | 80 | 2 min | Yes | Yes | 6 |
| 7 | Yes | 10 | 14 | No | 80 | 2 min | Yes | Yes | 10 |
| 7 | Yes | 25 | 10 | No | 25 | 5 sec | Yes | Yes | 20 |
| 7 | Yes | 25 | 11 | No | 25 | 5 sec | Yes | Yes | 13 |
| 7 | Yes | 25 | 12 | No | 25 | 5 sec | Yes | Yes | 11 |
| 7 | Yes | 25 | 13 | No | 25 | 5 sec | Yes | Yes | 2 |
| 8 | No | 10 | 14 | 1.5% $KMnO_4$, 1.5% $K_2MoO_4$, 1% $NaNO_3$ | 80 | 2 min | Yes | Yes | 38 |

FIG. 4B

| Corresponding Example | Boehmite | Conversion Solution Conditions | | | | | Post-Sealants | | Corrosion Performance |
|---|---|---|---|---|---|---|---|---|---|
| | | Ferrate (mM) | pH | Additives | Temp (° C) | Time | $Ca(OH)_2$ | Silicate | Salt Fog Results (days) |
| 8 | Yes | 3 | 14 | 1.5%$KMnO_4$, 1.5%$K_2MoO_4$, 1%$NaNO_3$ | 25 | 5 min | Yes | Yes | 1 |
| 8 | Yes | 3 | 14 | 3%$K_2MoO_4$, 1%$NaNO_3$ | 80 | 2 min | Yes | Yes | 10 |
| 8 | Yes | 3 | 14 | 3%$KMnO_4$, 1%$NaNO_3$ | 80 | 2 min | Yes | Yes | 14 |
| 8 | Yes | 3 | 14 | 1.5%$KMnO_4$, 1.5%$K_2MoO_4$, 1%$NaNO_3$ | 80 | 2 min | Yes | Yes | 19 |
| 8 | Yes | 10 | 14 | 3%$K_2MoO_4$, 1%$NaNO_3$ | 80 | 2 min | Yes | Yes | 16 |
| 8 | Yes | 10 | 14 | 3%$KMnO_4$, 1%$NaNO_3$ | 80 | 2 min | Yes | Yes | 21 |
| 8 | Yes | 10 | 14 | 1.5%$KMnO_4$, 1.5%$K_2MoO_4$, 1%$NaNO_3$ | 80 | 2 min | Yes | Yes | 40+ |
| 8 | Yes | 10 | 10 | 1.5%$KMnO_4$, 1.5%$K_2MoO_4$, 1%$NaNO_3$ | 80 | 2 min | Yes | Yes | 24 |

FIG. 4C

| Corresponding Example | Boehmite | Conversion Solution Conditions | | | | | Post-Sealants | | Corrosion Performance |
|---|---|---|---|---|---|---|---|---|---|
| | | Ferrate (mM) | pH | Additives | Temp (° C) | Time | $Ca(OH)_2$ | Silicate | Salt Fog Results (days) |
| 8 | Yes | 10 | 11 | 1.5%$KMnO_4$, 1.5%$K_2MoO_4$, 1%$NaNO_3$ | 80 | 2 min | Yes | Yes | 2 |
| 8 | Yes | 10 | 12 | 1.5%$KMnO_4$, 1.5%$K_2MoO_4$, 1%$NaNO_3$ | 80 | 2 min | Yes | Yes | 7 |
| 8 | Yes | 10 | 13 | 1.5%$KMnO_4$, 1.5%$K_2MoO_4$, 1%$NaNO_3$ | 80 | 2 min | Yes | Yes | 18 |
| 9 | No | 80 | 13.5 | EDTA | 25 | 2 min | Yes | Yes | 15 |
| 9 | Yes | 25 | 13.5 | EDTA | 25 | 2 sec | Yes | Yes | 18 |
| 9 | Yes | 25 | 13.5 | EDTA | 25 | 5 sec | Yes | Yes | 5 |
| 9 | Yes | 25 | 13.5 | EDTA | 25 | 10 sec | Yes | Yes | 5 |
| 9 | Yes | 25 | 13.5 | EDTA | 25 | 1 min | Yes | Yes | 8 |

FERRATE CONVERSION COATINGS FOR METAL SUBSTRATES

BACKGROUND OF THE INVENTION

1. Field of the Invention

The present invention relates to a method for forming a conversion coating on metal surfaces or substrates.

2. Background of the Related Art

In general, chemical conversion coatings are formed chemically by causing the surface of the metal to be "converted" into a tightly adherent coating, where either all or part of the conversion coating consists of an oxidized form of the substrate metal. Chemical conversion coatings can provide high corrosion resistance to the substrate as well as strong bonding affinity for paint. The industrial application of paint to metals generally requires the use of a chemical conversion coating, particularly when the performance demands are high.

Although aluminum protects itself against corrosion by forming a natural oxide coating, the protection is not complete. In the presence of moisture and electrolytes, aluminum alloys, particularly aluminum alloys with a high copper content, corrode much more rapidly than pure aluminum.

In general, there are two types of processes for treating aluminum to form a beneficial conversion coating. The first is by anodic oxidation (anodization) in which the aluminum component is immersed in a chemical bath, such as a chromic or sulfuric acid bath, and an electric current is passed through the aluminum component and the chemical bath. The conversion coating formed on the surface of the aluminum component offers resistance to corrosion and a bonding surface for organic finishes.

The second type of process is by chemically producing a conversion coating, which is commonly referred to as a chemical conversion coating, by subjecting the aluminum component to a chemical solution, such as a chromic acid solution, but without using an electric current in the process. The chemical solution may be applied by immersion application, by manual application, or by spray application. The resulting conversion coating on the surface of the aluminum component offers resistance to corrosion and a bonding surface for organic finishes.

Chromate based conversion coatings have been widely used in applications where maximum corrosion protection is an issue. Immersion of aluminum or aluminum alloys in a chromate conversion coating bath results in a thick, corrosion resistant film consisting of hydrated Cr (III) and Al(III) oxides. The reaction is driven by reduction of the high valent Cr(VI) ion and oxidation of the Al metal. Some of the benefits of a chromate conversion coating include hydrophobicity and self-healing properties.

Many aluminum structural parts, as well as Cd plated, Zn plated, Zn—Ni plated, and steel parts, throughout the aircraft and aerospace industry are currently being treated using this chromic acid process technology. Chromic acid conversion films, as formed on aluminum substrates, have been shown to meet a 168-hour corrosion resistance criterion, but they primarily serve as a surface substrate for paint adhesion. Because of their relative thinness and low coating weights (40–150 milligrams/ft$^2$), chromic acid conversion coatings do not reduce the fatigue life of the aluminum structure.

However, environmental regulations in the United States, particularly in California, and in other countries are drastically reducing the levels of hexavalent chromium compounds permitted in effluents and emissions from metal finishing processes. Accordingly, chemical conversion coating processes employing hexavalent chromium compounds need to be replaced.

Some of the most investigated non-chromate conversion coatings used in treatment of aluminum alloy-based materials are described below.

Sol-Gel technology uses polymers or metal oxides either alone or mixed to form complexes by the hydrolysis of appropriate precursor compounds. Sol-Gels can form powders or thin films that inhibit corrosion on substrates.

Fluorozirconium coating technology uses complexed transition metal salts to create a thin film on a substrate material similar to a conversion coating. Specifically, zirconium is mixed with fluorine to create fluorozirconium, which reacts with the part surface to form a coating.

Cobalt-based coatings use cobalt and molybdenum to treat substrate materials. The coatings created are low in electrical resistance and are good for corrosion resistance.

Rare Earth Metal (REM) salts may be applied by heated immersion to create protective layers on substrate materials. REMs provide corrosion resistance by producing a protective oxide film.

Potassium permanganate solutions can be used to create manganese oxide films on substrates. Manganese oxide films resulting from potassium permanganate treatment closely match the corrosion resistance of traditional chromic oxide films used in conversion coatings. Potassium permanganate coatings are very effective in protecting aluminum alloys.

Fluotitanic coatings, deposited from acid solutions with organic polymers, require few process steps, and can usually be done at ambient temperatures. Although these coatings have been widely used in a variety of applications, they have not been used in the aerospace industry.

Talc coatings, which are typically applied to aluminum substrates, are resistant to corrosion. These polycrystalline coatings are applied by precipitating aluminum-lithium compounds and other anions in an alkaline salt solution.

Anodizing is a process in which a metal surface is converted to an oxide layer, producing a tough, adherent surface layer. A thick oxide layer can be produced by immersing a part in an electrolytic solution and passing an electrical current through it, similar to electroplating. Then, by placing the part in boiling water, the film's pores can be sealed. As a result, the oxide changes from one form to another.

Despite these alternatives, there is a continuing need for a conversion coating solution that will form a stable, corrosion-resistant conversion coating on metal surfaces without containing or producing toxic chemicals. There is also a need for a conversion coating solution that provides enhanced corrosion protection on a variety of substrate materials and under a variety of conditions. Additionally, it would be desirable if the conversion coating provided a suitable surface for receiving organic coatings or paints.

SUMMARY OF THE INVENTION

The present invention provides a method for treating a metal surface, comprising the steps of contacting the metal surface with an aqueous solution comprising ferrate and oxidizing the metal surface with the ferrate. The ferrate is preferably selected from, but not limited to, a sodium ferrate salt, a potassium ferrate salt, a solution of ferrate in potassium hydroxide, a solution of ferrate in sodium hydroxide, and mixtures thereof and the ferrate concentration in the aqueous solution is preferably between, but not limited to, about 0.0166% and about 1.66% by weight.

The method uses the aqueous ferrate solution at a pH preferably greater than about 8, and most preferably either about 10 (between 9.5 and 10.5) or about 14 (greater than 13.5). The solution temperature may include any temperature, but lower temperatures will slow the rate of reaction between the ferrate and the substrate. Therefore, the preferred solution temperature is between about room temperature (typically referred to as 25° C.) and the boiling point of the aqueous solution (presumably about 100° C.). These methods have been shown to be effective on metals selected from aluminum, aluminum alloys, steels (e.g., carbon steels and stainless steels), and other ferrous metals. The metal surface is preferably contacted with the aqueous ferrate solution for between about 1 second and about 5 minutes. Where the terms "aluminum" and "aluminum alloys" are used herein, they should be interpreted to be inclusive of each other, i.e. "aluminum" does not exclude aluminum alloys, unless the description specifically states otherwise.

Optionally, the aqueous ferrate solution may further comprise one or more of a component selected from a salt, a transition metal oxyanion, an additional oxidizing agent, or ethylenediaminetetraacetic acid (EDTA). The preferred salts are selected from an alkali metal salt, an alkaline earth metal salt, or combinations thereof, and the salts are preferably provided at a concentration between about 0.1% and about 5.0% by weight. The preferred transition metal oxyanions are selected from, but not limited to, permanganate, molybdate, vanadate, tungstanate, cerate, or combinations thereof at a preferred concentration between about 0.1% and about 5% by weight. The additional oxidizing agent is preferably selected from peroxides (such as hydrogen peroxide or calcium peroxide), hypochlorite, ozone, and combinations thereof.

Optionally, the method may further comprise the steps of cleaning the metal surface prior to contacting the metal surface with the ferrate solution and/or exposing the cleaned metal surface to boiling water or anodization to form an oxide or hydrous oxide layer.

It is also optional to contact the conversion coating surface formed by ferrate oxidation with a post treatment solution containing one or more compounds selected from an alkali metal silicate, an alkali metal borate, an alkali metal phosphate, lithium nitrate, magnesium hydroxide, calcium hydroxide, barium hydroxide or mixtures thereof. Preferably, the concentration of the one or more compounds is between about 0.015% and about 5% by weight. If calcium hydroxide is used, the preferred concentration is between about 0.06% and about 0.09% by weight and, preferably, the solution is prepared in water in the absence of carbon dioxide. The post treatment is preferably conducted at a solution temperature between about 10° C. and about 100° C. for a period of between about 1 minute and about 20 minutes.

BRIEF DESCRIPTION OF THE DRAWINGS

So that the above recited features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

FIG. 4 is a table showing salt fog survival of ferrate conversion coatings prepared from various ferrate solutions with and without pre-treatment steps or post-sealing steps.

DETAILED DESCRIPTION OF THE INVENTION

Figure 1:
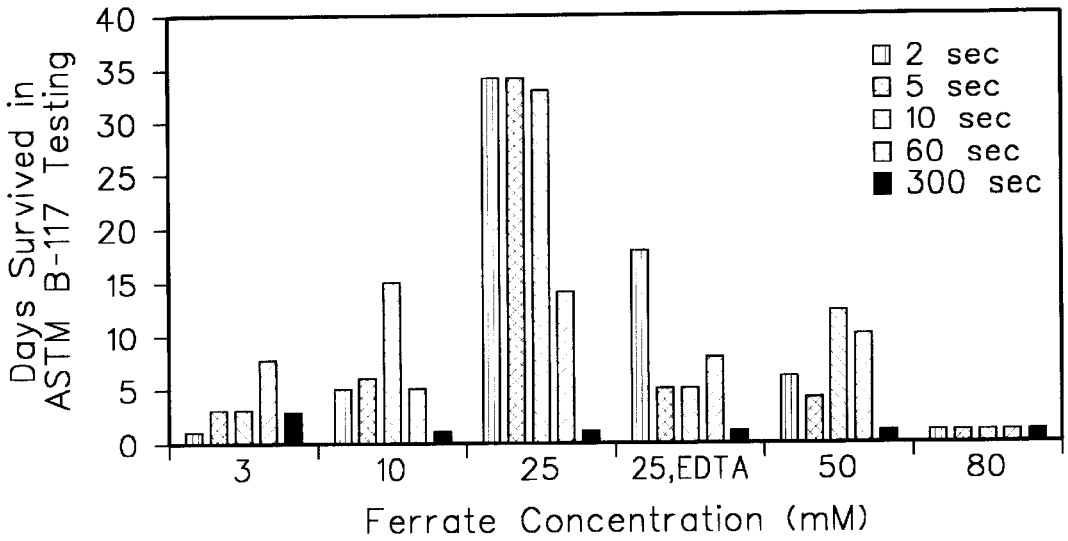
FIG. 1 is a graph showing salt fog survival of conversion coatings prepared at various ferrate concentrations between 3 mM and 80 mM, and various periods of contact between the ferrate solution and substrate ranging between 2 seconds and 5 minutes.
Figure 2:
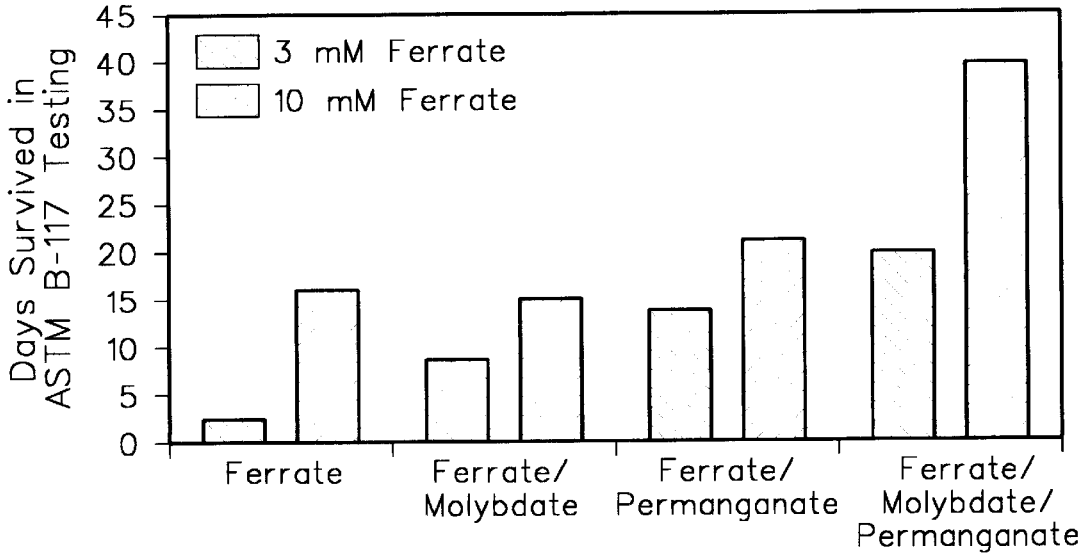
FIG. 2 is a graph showing salt fog survival of conversion coatings prepared with at two ferrate concentrations without oxyanions, with molybdate, with permanganate, and with both molybdate and permanganate.
Figure 3:
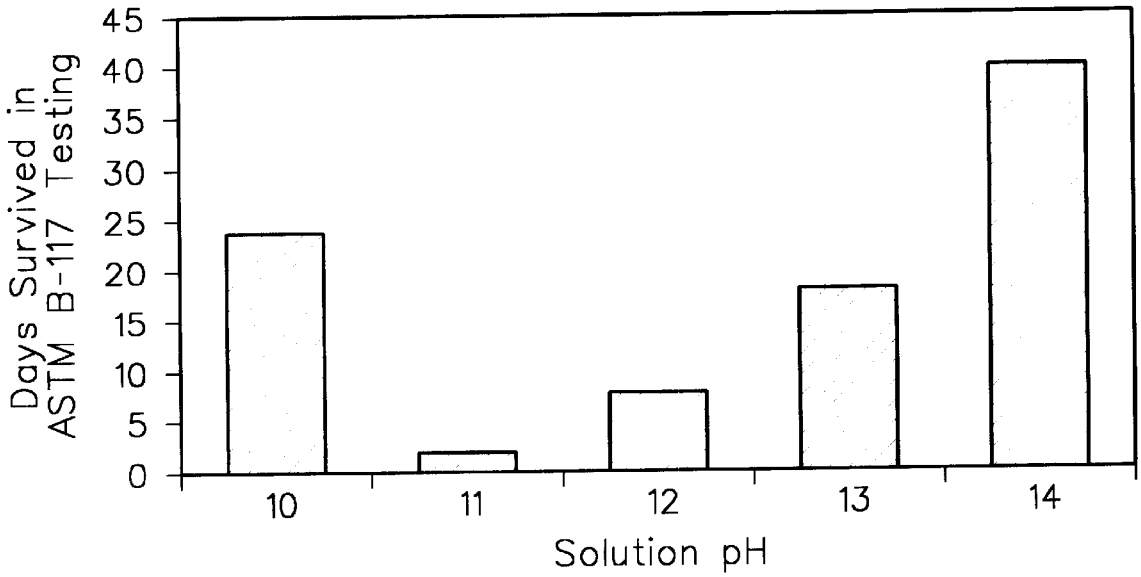
FIG. 3 is a graph showing salt fog survival of ferrate conversion coatings prepared with solution pH between 10 and 14.

The present invention provides a conversion coating process that forms a stable and corrosion-resistant oxide film on the surface of metal substrates using ferrate (VI) as the oxidizing agent. The conversion coating process uses an aqueous solution comprising ferrate anions, preferably having a ferrate anion concentration between about 1 millimolar (about 0.0166% by weight) and about 100 millimolar (about 1.66% by weight). The coating process is preferably carried out at temperatures ranging between about 10° C. and about 100° C., and preferably a contact time ranging between about 1 second and about 5 minutes. The conversion coating may be produced on various metal surfaces or substrates, including but not limited to aluminum, aluminum alloys, steels (e.g., carbon steels and stainless steels), and other ferrous metals. The pH of the ferrate solution is preferably equal to or greater than about 8 and most preferably about 10 or 14.

Optionally, yet preferably, the surface of the metal substrate is pre-treated before being contacted with the aqueous ferrate solution. Most preferably, the metal surface is cleaned by sonicating in acetone for 30 minutes, then cleaned in an alkaline solution. The cleaned metal surface may then be immersed in a deoxidizing solution such as LNC deoxidizer (Oakite Products Inc., Berkeley Heights, N.J.) to remove any residual oxide film from the metal surface. If the metal is aluminum or an aluminum alloy, the cleaned surface may then be exposed to boiling water or anodization to form an oxide layer.

Furthermore, the invention may include an optional post-treatment process for the conversion coating. After the metal surface has been oxidized with a ferrate-containing conversion coating solution, the conversion coating can then be sealed with a post-treatment solution containing a sealant selected from an alkali metal silicate, an alkali metal borate, an alkali metal phosphate, lithium nitrate, magnesium hydroxide, calcium hydroxide, or barium hydroxide, with the most preferred sealant being calcium hydroxide. The preferred conditions for the post-treatment include a sealant concentration between about 0.015% and about 5% by weight, a solution temperature between about 10° C. to about 100° C., and a contact time between about 1 minute and about 20 minutes. If calcium hydroxide is used, the post-treatment solution most preferably contains between about 0.06% and about 0.09% by weight calcium hydroxide and is prepared with water having a reduced carbon dioxide concentration.

The post-treatment step, for example using calcium hydroxide, is performed by reducing the concentration of carbon dioxide in water, forming a solution by combining calcium hydroxide with the water having a reduced concentration of carbon dioxide, and providing contact between the metal surface and the solution. The concentration of carbon dioxide in water may be reduced through any known process, but is preferably reduced by heating the water, most preferably to a temperature between 50° C. and 100° C. Other processes for reducing the carbon dioxide concentration in water include passing the water through an electroosmotic pump, passing the carbon dioxide through a hydrophobic membrane, use of carbon dioxide scavengers or centrifuging the water. It is important that the carbon dioxide content of the water be reduced, since the amount of carbon dioxide present in water at room temperature will yield a solution that does not produce the desired conversion coating.

Aluminum or other substrate panels prepared with ferrate conversion coatings are immersed in one or more post-treatment solutions, such as alkali metal silicate and calcium hydroxide, between 80° C. to 100° C. for 1 minute to 20 minutes. Preferably, the treated aluminum panels receive post-treatment by being immersed, first in an aqueous solution containing 0.09% by weight calcium hydroxide and 0.6% by weight lithium nitrate at 100° C. for 20 minutes, and second in an aqueous solution containing 2.4% by weight alkali metal silicate at 80° C. for 2 minutes. Optionally, the aqueous calcium hydroxide solution may further include manganese, molybdenum or a combination thereof that form stable metal oxides in the coatings and act as inhibitors to corrosion of the coatings.

The present invention provides a method that can be used to coat metal substrates with a non-toxic oxide film conversion coating that exhibits corrosion resistance comparable to chromate conversion coatings. The method includes contacting a metal surface with an aqueous solution containing ferrate to oxidize the metal surface, wherein the solution is preferably slightly alkaline. Ferrate contains iron in a +6 oxidation state ($Fe^{6+}$) and is thus quite useful as a powerful oxidizing agent. Suitable forms of ferrate include, but are not limited to, sodium ferrate salts, potassium ferrate salts, solutions of ferrate in potassium hydroxide, solutions of ferrate in sodium hydroxide, and mixtures thereof.

Ferrate (VI) for use in the solution of the present invention can be prepared in a number of ways. The ferrate (VI) anion can be produced by providing an aqueous solution of iron nitrate complexed with ethylenediaminetetraacetic acid, and hydroxide ions. A strong oxidizing agent, such as hydrogen peroxide, is then added to the solution to oxidize the iron (III) to ferrate (VI).

Ferrate may also be produced by electrochemical methods. Generally, iron metal can be used as the anode with a cathode made from carbon, nickel or other suitable material. In an alkaline solution, a current is applied across the anode and cathode which results in the oxidation of iron, from either an iron compound in the anolyte or the anode itself, to ferrate (VI). Large volumes of relatively high concentration ferrate (VI) can be produced by this method. The ferrate may then be precipitated to produce solid ferrate salts, or the solution can be used as a source of ferrate.

Optionally, the aqueous ferrate solution may include an alkali metal salt or an alkaline earth metal salt as an accelerator, activator, or passivator of the conversion coating reaction. Suitable alkali metal salts or alkaline earth metal salts include but are not limited to nitrates, chlorides, and fluorides, preferably lithium nitrate, lithium chloride, and sodium nitrate. The preferred alkali metal salt or alkaline earth metal salt concentration is between about 0.1% and about 5.0% by weight.

Optionally, the aqueous ferrate solution may further include transition metal oxyanions that form stable metal oxides in the coatings and act as inhibitors to corrosion of the coated metal. The transition metal oxyanions may be selected from, but are not limited to, permanganate, molybdate, vanadate, tungstanate, cerate, or combinations thereof, preferably at a concentration between about 0.1% and about 5% by weight.

Optionally, the aqueous ferrate solution may be stabilized by adding one or more additional oxidizing agents or ethylenediaminetetraacetic acid to the ferrate solution. Additional oxidizing agents may be selected from peroxides, hypochlorite, and ozone. The concentration of the additional oxidizing agents is preferably between about 0.1% to about 0.5% by weight. The presence of other oxidizing agents maintains the iron in the ferrate solution in a +6 oxidation state.

EXAMPLE 1

Preparation of Aluminum or Aluminum Panels

Except where indicated, aluminum or aluminum alloy panels were used in the following examples. Prior to contacting the panels with a coating solution, the panels were prepared by sonication in acetone for 30 minutes. They were then cleaned with an alkaline cleaning solution (such as 4215 NCLT available from Elf Atochem-Turco Products Division, Westminster, Calif.) for 10 minutes at 50° C. to 60° C. The panels were then rinsed with deionized water and immersed in a deoxidizing solution of 15% LNC deoxidizer (Oakite Products, Inc., Berkeley Heights, N.J.) for 10 minutes at room temperature. Optionally, the cleaned panels could then be exposed to boiling water or anodization to form an oxide layer. The panels were then thoroughly rinsed with deionized water and allowed to dry.

EXAMPLE 2

Aluminum or Aluminum Alloy Panels Treated with Conversion Coating Solutions Containing only Ferrate(VI)

Aqueous solutions of ferrate(VI) having concentrations between 0.0166% (1 mM) to 1.66% (100 mM) ferrate(VI) were prepared. Aluminum panels, prepared as described in Example 1, were immersed in each of the solutions for a period between 1 second and 5 minutes at a temperature between 25° C. and 80° C. The panels were then rinsed thoroughly with deionized water, dried in air for 48 to 94 hours, and tested by salt fog spray according to the ASTM B-117 test method (samples were placed at 15° angle).

EXAMPLE 3

Aluminum or Aluminum Alloy Panels Treated with Conversion Coating Solutions Containing Ferrate (VI) in Combination with One or More Oxyanions or Salts Aqueous solutions of ferrate(VI) having concentrations between 0.0166% (1 mM) and 1.66% (100 mM) ferrate(VI), with or without 0.5% sodium nitrate, 1.0% to 3.0% of one or more of potassium permanganate and potassium molybdate, and 0.5% to 1.0% of one or more of lithium chloride or lithium nitrate were prepared. The aluminum panels prepared as described in Example 1 were immersed in this conversion coating solution for between 1 second and 5 minutes at temperatures between 25° C. and 80° C. The panels were then rinsed thoroughly with deionized water, dried in air for 48 to 94 hours, and tested by salt fog spray according to ASTM B-117 test method (samples were placed at 15° angle).

EXAMPLE 4

Aluminum or Aluminum Alloy Panels Treated with Conversion Coating Solutions Containing Ferrate (VI) and EDTA at Low Hydroxide Concentrations Aqueous solutions of ferrate(VI) with EDTA having concentrations between 0.0166% to 1.66% ferrate(VI) at a pH between 13 and 13.5 were prepared. Aluminum or aluminum alloy panels prepared as described in Example 1, were immersed in this conversion coating solution for between 1 second to 10 minutes at temperatures between 25° C. to 80° C. The panels were then rinsed thoroughly with deionized water, dried in air for 48 to 94 hours, and tested by salt fog spray according to the ASTM B-117 test method (samples were placed at 15° angle).

EXAMPLE 5

Aluminum or Aluminum Alloy Panels Treated with Conversion Coating Solutions Containing Ferrate (VI) and EDTA at low Hydroxide Concentrations in Combination with One or More Oxyanions or Salts Aqueous solutions of ferrate(VI) with EDTA having concentrations between 0.0166% to 1.66% ferrate(VI) at a pH between 13 and 13.5 were prepared. The solutions could also contained 1.0% to 3.0% of one or more of potassium permanganate and potassium molybdate, and 0.5% to 1.0% of one or more of lithium chloride, lithium nitrate, or sodium nitrate. Aluminum panels prepared as described in Example 1, were immersed in this conversion coating solution for between 1 second and 10 minutes at temperatures between 25° C. and 80° C. The panels were then rinsed thoroughly with deionized water, dried in air for 48 to 94 hours, and tested by salt fog spray according to the ASTM B-117 test method (samples were placed at 15° angle).

EXAMPLE 6

Aluminum or Aluminum Alloy Panels Treated with Multiple Exposures to Conversion Coating Solutions Containing Ferrate(VI)

Aluminum or aluminum alloy panels prepared as described in Example 1, were immersed in the conversion coating solutions as described in Examples 2 to 5 for 1 second to 1 minute at temperatures between 25° C. and 80° C. After exposure to one such conversion coating solution, the aluminum panels were removed and immersed in a fresh conversion coating solution for the same time period. This process was repeated between two and six times. The panels were then rinsed thoroughly with deionized water, dried in air for 48 to 94 hours, and tested by salt fog spray according to the ASTM B-117 test method (samples were placed at 15° angle).

EXAMPLE 7

Aluminum or Aluminum Alloy Panels Treated with Conversion Coating Solutions Containing Only Ferrate(VI) and then Treated with Post-sealants Aqueous solutions of ferrate(VI) having concentrations ranging between 0.0166% to 1.66% ferrate(VI) were prepared. Aluminum panels, prepared as described in Example 1 , were immersed in each of the solutions for periods ranging from 1 second to 5 minutes at a temperature ranging between 25° C. and 80° C. The treated aluminum panels then received post-treatment by being immersed, first in an aqueous solution containing 0.09% by weight calcium hydroxide and 0.6% by weight lithium nitrate at 100° C. for 20 minutes, and second in an aqueous solution containing 2.4% by weight alkali metal silicate at 80° C. for 2 minutes. The panels were then rinsed thoroughly with deionized water, dried in air for 48 to 94 hours, and tested by salt fog spray according to the ASTM B-117 test method (samples were placed at 15° angle).

EXAMPLE 8

Aluminum or Aluminum Alloy Panels Treated with Conversion Coating Solutions Containing Ferrate (VI) in Combination with One or More Oxyanions or Salts and then Treated with Post-sealants Aqueous solutions of ferrate(VI) having concentrations between 0.0166% and 1.66% ferrate(VI), with or without 0.5% sodium nitrate, 1.0% to 3.0% of one or more of potassium permanganate and potassium molybdate, and 0.5% to 1.0% of one or more of lithium chloride or lithium nitrate were prepared. The aluminum panels prepared as described in Example 1, were immersed in this conversion coating solution for between 1 seconds and 5 minutes at temperatures between 25° C. and 80° C. The treated aluminum panels then received post-treatment by being immersed, first in an aqueous solution containing 0.09% by weight calcium hydroxide and 0.6% by weight lithium nitrate at 100° C. for 20 minutes, and second in an aqueous solution containing 2.4% by weight alkali metal silicate at 80° C. for 2 minutes. The panels were then rinsed thoroughly with deionized water, dried in air for 48 to 94 hours, and tested by salt fog spray according to ASTM B-117 test method (samples were placed at 15° angle).

EXAMPLE 9

Aluminum or Aluminum Alloy Panels Treated with Conversion Coating Solutions Containing Ferrate (VI) and EDTA at Low Hydroxide Concentrations and then Treated with Post-sealants Aqueous solutions of ferrate(VI) with EDTA having concentrations between 0.0166% to 1.66% ferrate(VI) at a pH between 13 and 13.5 were prepared. Aluminum panels prepared as described in Example 1, were immersed in this conversion coating solution for between 1 second to 10 minutes at temperatures between 25° C. to 80° C. The treated aluminum panels then received post-treatment by being immersed, first in an aqueous solution containing 0.09% by weight calcium hydroxide and 0.6% by weight lithium nitrate at 100° C. for 20 minutes, and second in an aqueous solution containing 2.4% by weight alkali metal silicate at 80° C. for 2 minutes. The panels were then rinsed thoroughly with deionized water, dried in air for 48 to 94 hours, and tested by salt fog spray according to the ASTM B-117 test method (samples were placed at 15° angle).

EXAMPLE 10

Aluminum or Aluminum Alloy Panels Treated with Conversion Coating

Solutions Containing Ferrate(VI) and EDTA at Low Hydroxide Concentrations in Combination with One or More Oxyanions or Salts and then Treated with Post-sealants Aqueous solutions of ferrate(VI) with EDTA having concentrations between 0.0166% to 1.66% ferrate(VI) at a pH between 13 and 13.5 were prepared. The solutions also contained 1.0% to 3.0% of one or more of potassium permanganate and potassium molybdate, and 0.5% to 1.0% of one or more of lithium chloride, lithium nitrate, or sodium nitrate. Aluminum panels prepared as described in Example 1, were immersed in this conversion coating solution for between 1 seconds and 10 minutes at temperatures between 25° C. and 80° C. The treated aluminum panels were then immersed in one or more post-treatment solutions, such as alkali metal silicate and calcium hydroxide, between 80° C. to 100° C. for 1 minute to 20 minutes. The panels were then rinsed thoroughly with deionized water, dried in air for 48 to 94 hours, and tested by salt fog spray according to the ASTM B-117 test method (samples were placed at 15° angle).

EXAMPLE 11

Aluminum or Aluminum Alloy Panels Treated with Multiple Exposures to Conversion Coating Solutions Containing Ferrate(VI) and then Treated with Post-sealants Aluminum panels prepared as described in Example 1, were immersed in the conversion coating solutions as described in Examples 2 to 5 for 1 second to 1 minute at temperatures between 25° C. and 80° C. After exposure to one such conversion coating solution, the aluminum panels were removed and immersed in a fresh conversion coating solution for the same time period. This process was repeated between two and six times. The treated aluminum panels were then immersed in one or more post-treatment solutions, such as alkali metal silicate and calcium hydroxide, between 80° C. to 100° C. for 1 minute to 20 minutes. The panels were then rinsed thoroughly with deionized water, dried in air for 48 to 94 hours, and tested by salt fog spray according to the ASTM B-117 test method (samples were placed at 15° angle).

EXAMPLE 12

Stabilization of Ferrate(VI) in the Conversion Coating Solution

The ferrate(VI) anions in the conversion coating solution may be stabilized by the addition of oxidizers such as peroxides, hypochlorites, ozone, or other oxidizers. The concentrations of these oxidizers can be varied between 1.0% and 0.5% by weight.

While the foregoing is directed to the preferred embodiment of the present invention, other and further embodiments of the invention may be devised without departing from the basic scope thereof, and the scope thereof is determined by the claims that follow.

We claim:

1. An aqueous oxidizing solution of transition metal oxyanion salts, each transition metal oxyanion salt having a transition metal oxyanion concentration of 1–100 mmol/l wherein the transition metal oxyanions comprise ferrate (VI) ($FeO_4^{2-}$) and one or more transition metal oxyanions selected from the group consisting of permanganate, molybdate, vanadate, tungstate and combinations thereof, and wherein the solution has a pH greater than 13.5.

2. The oxidizing solution of claim 1, wherein the solution has a pH of about 14.

3. An oxidizing solution comprising: transition metal oxyanion salts, each transition metal oxyanion salt having a transition metal oxyanion concentration of 1–100 mmol/l, wherein the transition metal oxyanions comprise ferrate (VI) ($FeO_4^{2-}$) and one or more transition metal oxyanions selected from the group consisting of permanganate, molybdate, vanadate, tungstate and combinations thereof; and one or more additional oxidizing agents selected from the group consisting of peroxide, hypochlorite, ozone and combinations thereof, wherein the solution has a pH greater than 13.5.

4. The solution of claim 1, wherein the ferrate (VI) oxyanion is provided by a compound selected from a sodium ferrate (VI) salt, a potassium ferrate (VI) salt, a solution of ferrate (VI) in potassium hydroxide, a solution of ferrate (VI) in sodium hydroxide and mixtures thereof.

5. An oxidizing solution comprising: transition metal oxyanion salts, each transition metal oxyanion salt having a transition metal oxyanion concentration of 1–100 mmol/l, wherein the transition metal oxyanions comprise ferrate (VI) ($FeO_4^{2-}$) and one or more transition metal oxyanions selected from the group consisting of permanganate, molybdate, vanadate, tungstate and combinations thereof; and ethylenediaminetetraacetic acid, wherein the solution has a pH greater than 13.5.

6. The solution of claim 1, further comprising a salt selected from an alkali metal, or an alkaline earth metal, chloride, fluoride or combinations thereof.

7. The solution of claim 1, wherein the solution has a temperature in the range 10–100° C.

8. The solution of claim 6, wherein the salt concentration is between about 0.1% and about 5.0% by weight.

9. The solution of claim 1, wherein the one or more transition metal oxyanions includes molybdate in the form $MoO_4^{2-}$.

10. An aqueous oxidizing solution of transition metal oxyanion salts, each transition metal oxyanion salt having a transition metal oxyanion concentration of 1–100 mmol/l, wherein the transition metal oxyanions comprise ferrate (VI) ($FeO_4^{2-}$) and one or more transition metal oxyanions selected from the group consisting of permanganate, molybdate, vanadate, tungstate and combinations thereof, and wherein the solution has a pH greater than 14.

11. An aqueous oxidizing solution consisting essentially of transition metal oxyanion salts, each transition metal oxyanion salt having a transition metal oxyanion concentration of 1–100 mmol/l, wherein the transition metal oxyanions comprise ferrate (VI) ($FeO_4^{2-}$) and one or more transition metal oxyanions selected from the group consisting of permanganate, molybdate, vanadate, tungstate and combinations thereof, and wherein the solution has a pH greater than 13.5.

12. An oxidizing solution of transition metal oxyanion salts, each transition metal oxyanion salt having a transition metal oxyanion concentration of 5–100 mmol/l, wherein the transition metal oxyanions comprise ferrate (VI) ($FeO_4^{2-}$) and one or more transition metal oxyanions selected from the group consisting of permanganate, molybdate, vanadate, tungstate and combinations thereof, and wherein the solution has a pH greater than 13.5.

13. An oxidizing solution of transition metal oxyanion salts, each transition metal oxyanion salt having a transition metal oxyanion concentration of 1–100 mmol/l, wherein the transition metal oxyanions comprise ferrate (VI) ($FeO_4^{2-}$) and one or more transition metal oxyanions selected from the group consisting of permanganate, molybdate, vanadate, tungstate and combinations thereof, wherein the solution has a pH greater than 13.5, and wherein the solution does not contain silicate.

14. The solution of claim 7, wherein the solution has a temperature in the range 25–100° C.

15. The solution of claim 14, wherein the solution has a temperature in the range 25–80° C.

16. An aqueous oxidizing solution of transition metal oxyanion salts, each transition metal oxyanion salt having a transition metal oxyanion concentration of 1–100 mmol/l, wherein the transition metal oxyanions comprise ferrate (VI) ($FeO_4^{2-}$) and one or more transition metal oxyanions selected from the group consisting of permanganate, molybdate, vanadate, tungstate, cerate and combinations thereof, wherein the solution has a pH greater than 13.5, and wherein the solution does not contain silicate.

17. An oxidizing solution comprising: transition metal oxyanion salts, each transition metal oxyanion salt having a transition metal oxyanion concentration of 1–100 mmol/l, wherein the transition metal oxyanions comprise ferrate (VI) ($FeO_4^{2-}$) and one or more transition metal oxyanions selected from the group consisting of permanganate, molybdate, vanadate, tungstate, cerate and combinations thereof, and one or more additional oxidizing agents selected from the group consisting of peroxide, hypochlorite, ozone and combinations thereof, wherein the solution has a pH greater than 13.5.

18. An aqueous oxidizing solution of transition metal oxyanion salts, each transition metal oxyanion salt having a transition metal oxyanion concentration of 5–100 mmol/l, wherein the transition metal oxyanions comprise ferrate (VI) ($FeO_4^{2-}$) and one or more transition metal oxyanions selected from the group consisting of permanganate, molybdate, vanadate, tungstate, cerate and combinations thereof, and wherein the solution has a pH greater than 13.5.

* * * * *